US011953202B2

(12) United States Patent
Aldrich et al.

(10) Patent No.: US 11,953,202 B2
(45) Date of Patent: Apr. 9, 2024

(54) WASTE GAS COMBUSTOR

(71) Applicant: Clear Rush Corporation, Sundre (CA)

(72) Inventors: Christopher Lucien Aldrich, Sundre (CA); Dale Christopher Aldrich, Sundre (CA); Dallas Lane Rosevear, Sundre (CA)

(73) Assignee: Clear Rush Corporation, Sundre (CA)

( * ) Notice: Subject to any disclaimer, the term of this patent is extended or adjusted under 35 U.S.C. 154(b) by 158 days.

(21) Appl. No.: 17/488,558

(22) Filed: Sep. 29, 2021

(65) Prior Publication Data

US 2022/0099293 A1 Mar. 31, 2022

Related U.S. Application Data

(60) Provisional application No. 63/084,687, filed on Sep. 29, 2020.

(51) Int. Cl.

| | |
|---|---|
| ***F23G 7/08*** | (2006.01) |
| ***F23D 14/82*** | (2006.01) |
| ***F23G 5/50*** | (2006.01) |
| ***F23L 1/02*** | (2006.01) |

(52) U.S. Cl.

CPC ..... *F23G 7/085* (2013.01); *F23D 14/82* (2013.01); *F23G 5/50* (2013.01); *F23L 1/02* (2013.01); *F23G 2207/101* (2013.01); *F23G 2209/14* (2013.01)

(58) Field of Classification Search

CPC ... F23G 7/06; F23G 7/085; F23G 5/50; F23D 14/82; F23L 1/02

USPC ..... 431/202, 5, 354; 110/241, 242

See application file for complete search history.

(56) References Cited

U.S. PATENT DOCUMENTS

| | | | | |
|---|---|---|---|---|
| 1,124,529 | A * | 1/1915 | Rudd | F23G 5/40 110/255 |
| 6,485,292 | B1 * | 11/2002 | Rhodes | F23G 7/085 95/166 |
| 2014/0147795 | A1 * | 5/2014 | Tremblay | F23G 7/085 431/5 |
| 2015/0167972 | A1 * | 6/2015 | Zhdaneev | F23N 5/003 431/14 |

* cited by examiner

*Primary Examiner* — Vivek K Shirsat

(74) *Attorney, Agent, or Firm* — Scott Griggs; Griggs Bergen LLP

(57) ABSTRACT

A combustor having a rectangular prism structure with a burner assembly mounted inside for burning waste hydrocarbon gases with combustion air provided through flame arrestors from outside atmospheric air, the combusted hydrocarbon gas exiting through an opening on top of the structure. The combustor includes a controller for operating an igniter on the burner assembly and thermocouples for measuring the temperature of exhaust gas exiting the combustor and for measuring the skin temperature of the structure. The controller can relay the operational data and the location of the combustor to a central control center through a SCADA unit connected to a telecommunications network. The controller can also relay the volume of waste gas burned to the central control center to determine the carbon credits earned by preventing the waste gas being vented to the atmosphere.

18 Claims, 15 Drawing Sheets

WASTE GAS COMBUSTOR

PRIORITY STATEMENT & CROSS-REFERENCE TO RELATED APPLICATIONS

This application claims priority from U.S. Patent Application Ser. No. 63/084,687 entitled "Waste Gas Combustor" and filed on Sep. 29, 2020, in the names of Christopher Lucien Aldrich, et al.; which is hereby incorporated by reference, in entirety, for all purposes.

TECHNICAL FIELD OF THE INVENTION

The present disclosure is related to the field of combustors, in particular, combustors for eliminating low pressure and low volume waste gas from hydrocarbon producing wells and hydrocarbon production facilities in addition to hydrocarbon gases produced from agricultural activities and from municipal landfills, waste management systems and sewage systems.

BACKGROUND OF THE INVENTION

Combustors can be used for burning off or combusting waste gas from a hydrocarbon producing well or hydrocarbon production facilities where the waste gas is of too low a pressure or volume, or both, to be of any use as a downstream hydrocarbon product. Combusting the waste gas is the environmentally friendly method of disposing of the waste gas as allowing the waste gas to vent to the atmosphere can be an environmental hazard as it can add to and worsen the effect of greenhouse gases ("GHGs") in the atmosphere. Simply venting waste gas to the atmosphere is also contrary to environmental regulations in many jurisdictions.

Prior art combustors are typically a vertically oriented cylindrical structure that are difficult to transport and to install at a site. When placed at a site near a well or venting system, prior art combustors require a cement pad to be first placed to be mounted on. Prior art combustors often require to be supported and stabilized with guy wires in addition to mounting on a cement pad. Due to their configuration, transporting prior art combustors is difficult and a typical truck trailer is limited to carrying only two to three prior art combustors at a time, which increases transportation and logistics costs in moving such combustor to and from well sites and venting equipment. The requirement of placing cement pads and the use of guy wires for stabilization increases both the time and cost to place prior art combustors.

By using combustors to burn off waste fuel gas from oil and gas facilities, as well as from land fill waste gas and agricultural waste, doing so can reduce the amount of GHGs being emitted to atmosphere. In so doing, carbon credits can be acquired by operators of combustors based on the amount of GHGs being destroyed. A problem arising from this, however, is the ability to monitor and collect of data relating to the amount and type of GHGs that are burned off. It is possible to manually monitor the amount of GHGs combusted but doing so can be prone to errors and inaccuracies and may result in the operator not acquiring all the carbon credits they may be entitled to. Combustors can also be located in remote and often difficult places to reach, which makes accurate collection of data of GHG combustion more difficult.

It is, therefore, desirable to provide a combustor that can be easily transported and placed in close proximity to hydrocarbon producing wells and oil and gas production and storage facilities and equipment for disposing of waste gases that would be otherwise vented into the atmosphere and to provide means for accurate monitoring and collection of data of the combustion of GHGs.

SUMMARY OF THE INVENTION

A combustor having a rectangular prism structure, enclosed on a bottom surface and 4 sidewalls thereof with a top side left open for heat and combustion by-products to exit therefrom, can be provided with a burner assembly mounted inside for burning waste gas with combustion air provided through flame arrestors from outside atmospheric air. The combustor can comprise a controller, configured as a burner management system, for operating an igniter disposed on the burner assembly, and can further comprise thermocouples for measuring the temperature of exhaust gas exiting the combustor and for measuring the skin temperature of the structure wherein the thermocouples can provide temperature information to the controller for controlling the operation of the combustor. In some embodiments, the combination of the burner management system, the flame arrestors and the thermocouples can allow the combustor to be placed as close as 10 meters to a well or gas venting equipment as the burner management system can be configured to monitor the exhaust temperature and the skin temperature of the combustor and control the rate of combustion of waste gas to keep those temperatures from exceeding the auto-ignition temperature of the waste gases. By reducing the distance, the combustor can be placed near a well or venting equipment, this reduces the length, diameter and cost of the piping required to supply waste gas to the combustor.

In some embodiments, the combustor can comprise a square base that can be lifted and transported by a forklift. In some embodiments, the combustor can further comprise rectangular sidewalls wherein the resulting combustor can be easily placed at a well site or near venting equipment without having a cement pad placed first; the combustor can be placed directly onto the ground and not require additional stabilization with guy wires and the like. By eliminating the need of a cement pad, the time and cost to place the combustor near a well site or venting equipment can be reduced.

In some embodiments, the square base can be nominally 60 inches on a side and the sidewalls can be nominally 120 inches tall. In such configurations, 7 to 8 units of the combustor can be transported on a flat deck trailer or B-train trailer. This can reduce the cost of transportation and logistics of moving the combustor to and from sites as compared to prior art combustors.

In some embodiments, the combustor can be used to safely dispose of waste hydrocarbon gases produced from oil and gas production activities, agricultural activities and from municipal landfills, waste management systems and sewage systems.

In some embodiments, the combustor can come equipped with a burner management system, valve train and flow meter. The flow meter can measure the gas flow being burnt in the combustor that, in turn, can send data to the burner management system that can operate as a supervisory control and data acquisition ("SCADA") system that can control data coming acquired about the GHGs being combusted. In some embodiments, the burner management system can wirelessly transmit the data using a cellular transceiver device over a telecommunications network such as through the public switched telephone network ("PSTN"). This cellular device can then send the raw data to a central monitoring system for a geographic region where the central monitoring system can comprise a software platform that can store data received from a particular combustor. In some embodiments, the burner management system can safely light the combustor and monitor temperatures therein as well as providing visual indications of the temperatures for the operators to read.

The combination of the burner management system and the cellular unit can provide flow value and temperature data in addition to operation data as to whether the combustor is operating or not as well as the location of the combustor. Operators can be notified through the software program as to whether the combustors are running and to their whereabouts so they know where to go to check on them and get them up and running again in the event the combustor ceases to operate. By operating combustors using the systems and methods described herein, operators can maximize the operating time of their combustors with minimal manpower given that the status and operation of every combustor can be monitored by the central control center. In addition, the central control center can accurately monitor the volume of waste gas burned by each combustor thereby ensuring the operator can accurately track the amount of carbon credits they can acquire from the volume of waste burned from each combustor. This enables operators to maximize the carbon credits they are able to earn from the waste gas being combusted by the combustor.

Broadly stated, in some embodiments, a combustor can be provided, comprising: an enclosure, further comprising a bottom panel and a plurality of sidewall panels disposed around a perimeter of the bottom panel, the plurality of sidewall panels extending upwardly from the perimeter of the bottom panel, the plurality of sidewall panels operatively coupled together around the perimeter to form a combustion chamber; a burner assembly disposed within the combustion chamber; a gas inlet pipe operatively coupled to the burner assembly, the gas inlet pipe configured to supply waste gas to the burner assembly; an air inlet disposed through at least one of the plurality of sidewall panels; and at least one flame arrestor operatively coupled to the air inlet on an exterior side of the plurality of sidewall panels, the at least one flame arrestor configured to allow atmospheric air to enter the combustion chamber for use as combustion air for the burner assembly.

Broadly stated, in some embodiments, the combustor can comprise an access door disposed on one of the sidewall panels.

Broadly stated, in some embodiments, the access door can comprise one of the at least one flame arrestor disposed thereon.

Broadly stated, in some embodiments, the combustor can comprise an air intake duct configured for providing communication from the air inlet to the burner assembly.

Broadly stated, in some embodiments, the bottom panel can be substantially square in configuration and each of the plurality of sidewall panels can be substantially rectangular in configuration.

Broadly stated, in some embodiments, the bottom panel can be up to nominally 60 inches by nominally 60 inches in dimension and each of the plurality of sidewall panels can be up to nominally 60 inches by nominally 120 inches in dimension.

Broadly stated, in some embodiments, the burner assembly can further comprise at least one burner unit wherein each of the at least one burner unit comprises: a pair of substantially parallel concave sidewalls configured to form a venturi-like throat structure, each concave sidewall comprising a plurality of holes disposed therethrough; a pair of substantially parallel end plates, each end plate disposed at opposing ends of the concave sidewalls and operatively coupled thereto; and a burner pipe disposed between the concave sidewalls in the venturi-like throat structure.

Broadly stated, in some embodiments, the at least one burner unit can comprise a plurality of top braces disposed between the concave sidewalls.

Broadly stated, in some embodiments, one or both of the concave side walls can comprise a plurality of perforations disposed therethrough.

Broadly stated, in some embodiments, the at least one burner unit can further comprise a flame containment plate disposed on top of one or both of the substantially parallel end plates.

Broadly stated, in some embodiments, the combustor can further comprise a controller configured for controlling the operation of the burner assembly.

Broadly stated, in some embodiments, the burner assembly can comprise at least one igniter configured for igniting waste gas exiting the burner pipe upon receiving an ignition signal from the controller.

Broadly stated, in some embodiments, the combustor can comprise an exhaust gas temperature thermocouple operatively coupled to the controller.

Broadly stated, in some embodiments, the combustor can comprise a sidewall panel skin temperature thermocouple operatively coupled to the controller.

Broadly stated, in some embodiments, the combustor can comprise a wireless communications transceiver operatively coupled to the controller, the transceiver configured to exchange data with a central control center over a telecommunications network.

Broadly stated, in some embodiments, the combustor can further comprise a valve train operatively coupled to the gas inlet pipe, the valve train configured to control and monitor the flow of the waste gas into the gas inlet pipe.

Broadly stated, in some embodiments, a method can be provided for determining the amount of waste gas supplied to a combustor, comprising: supplying the waste gas to the combustor, the combustor comprising: an enclosure, further comprising a bottom panel and a plurality of sidewall panels disposed around a perimeter of the bottom panel, the plurality of sidewall panels extending upwardly from the perimeter of the bottom panel, the plurality of sidewall panels operatively coupled together around the perimeter to form a combustion chamber, a burner assembly disposed within the combustion chamber, a gas inlet pipe operatively coupled to the burner assembly, the gas inlet pipe configured to supply waste gas to the burner assembly, an air inlet disposed through at least one of the plurality of sidewall panels, and at least one flame arrestor operatively coupled to the air inlet on an exterior side of the plurality of sidewall panels, the at least one flame arrestor configured to allow atmospheric air to enter the combustion chamber for use as combustion air for the burner assembly; monitoring the amount of the waste gas supplied to the combustor with a flow meter, the flow meter configured to provide a gas flow signal to a controller, the controller further configured to derive gas flow data from the gas flow signal; transmitting the gas flow data to a central control center; and determining the amount of the waste gas supplied to and burned by the combustor from the gas flow data.

Broadly stated, in some embodiments, the method can further comprise transmitting the gas flow data over a telecommunications network.

Broadly stated, in some embodiments, the method can further comprise determining the amount of carbon credits associated with the amount of the supplied to and burned by the combustor.

DETAILED DESCRIPTION OF THE INVENTION

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment can also be included in other embodiments but is not necessarily included. Thus, the present technology can include a variety of combinations and/or integrations of the embodiments described herein.

Figure 1:
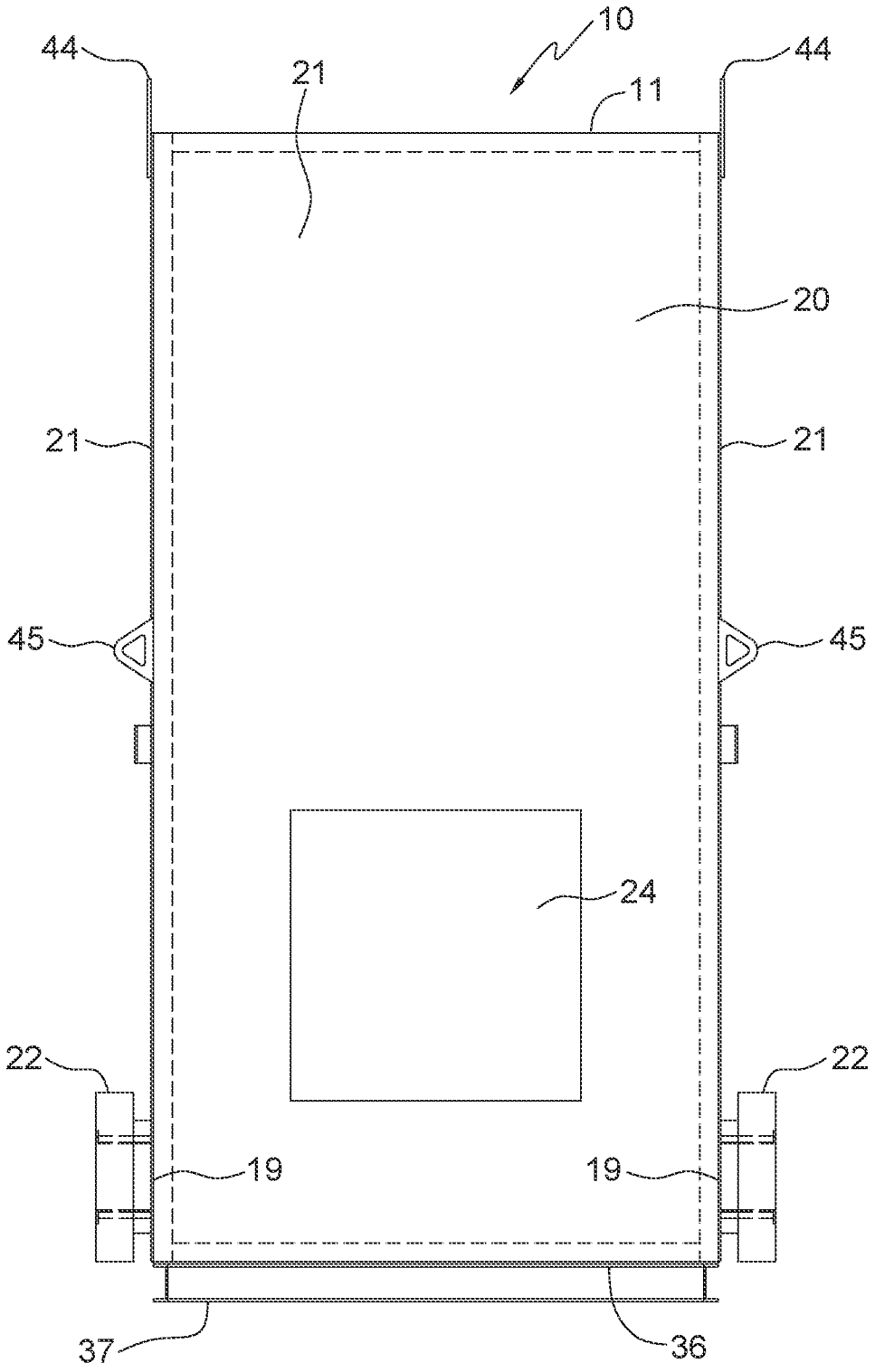
FIG. 1 is a front elevation view depicting a first embodiment of a combustor.
Figure 2:
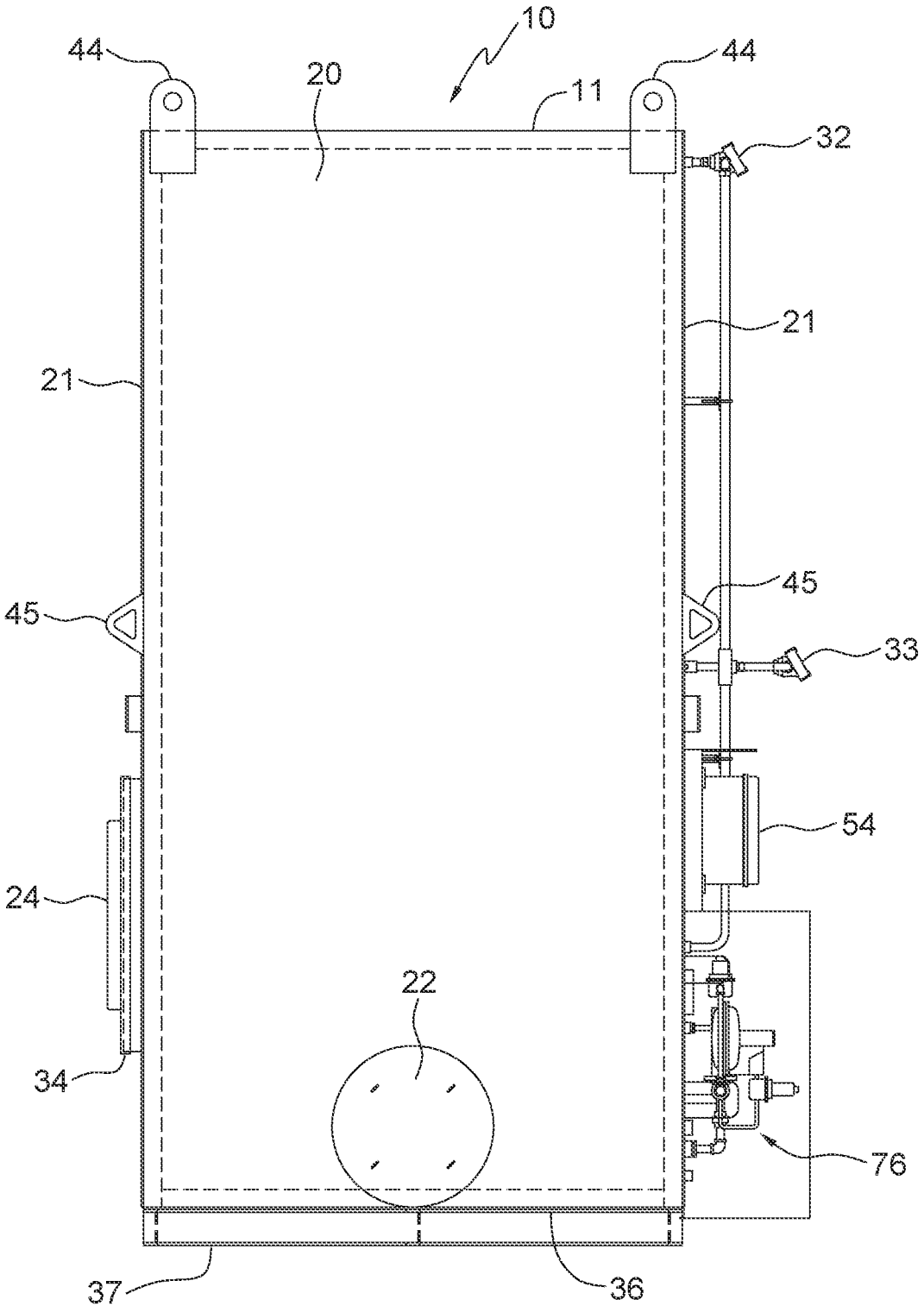
FIG. 2 is a side elevation view depicting the combustor of FIG. 1.
Figure 3:
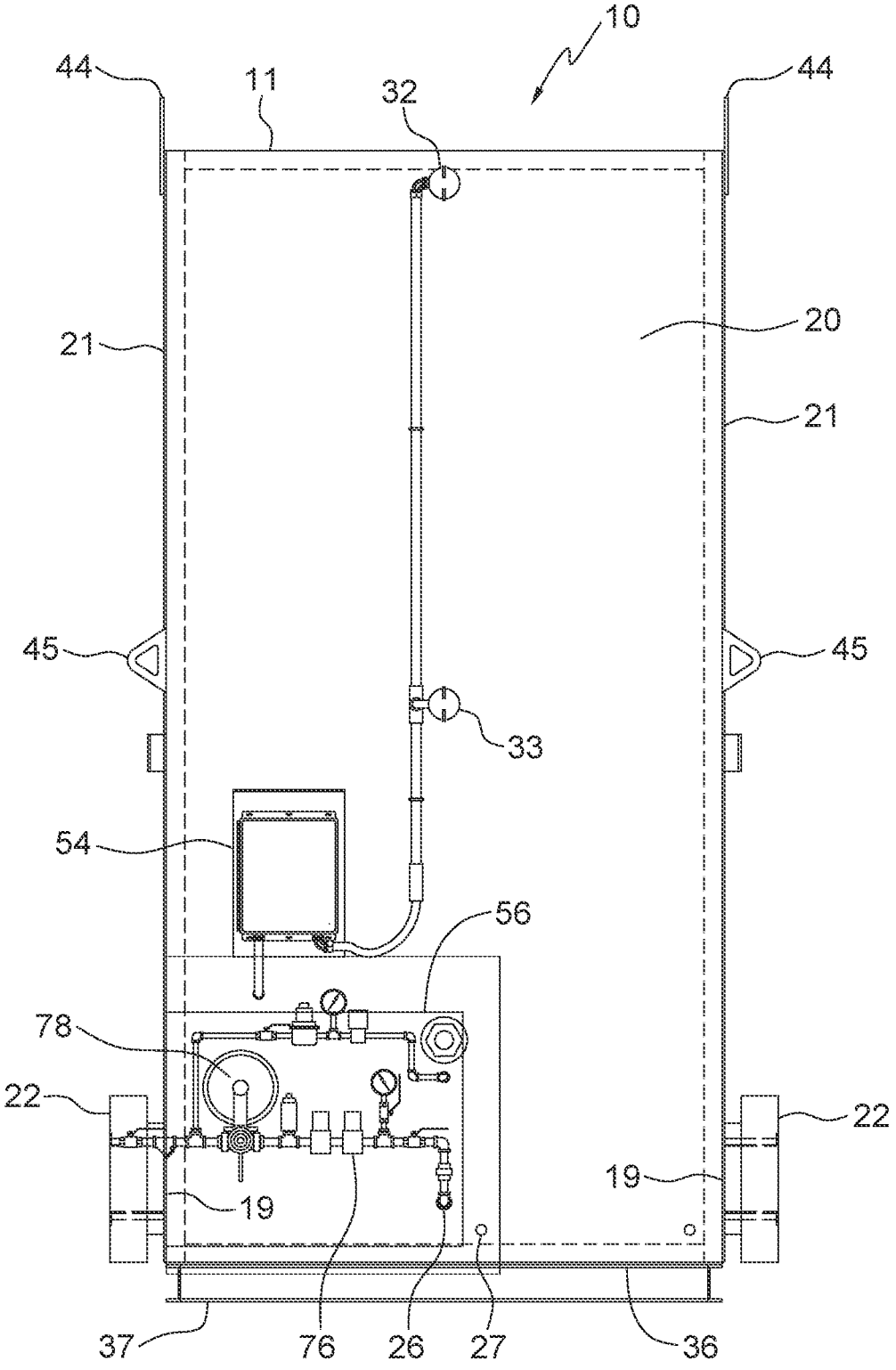
FIG. 3 is a rear elevation view depicting the combustor of FIG. 1.
Figure 4:
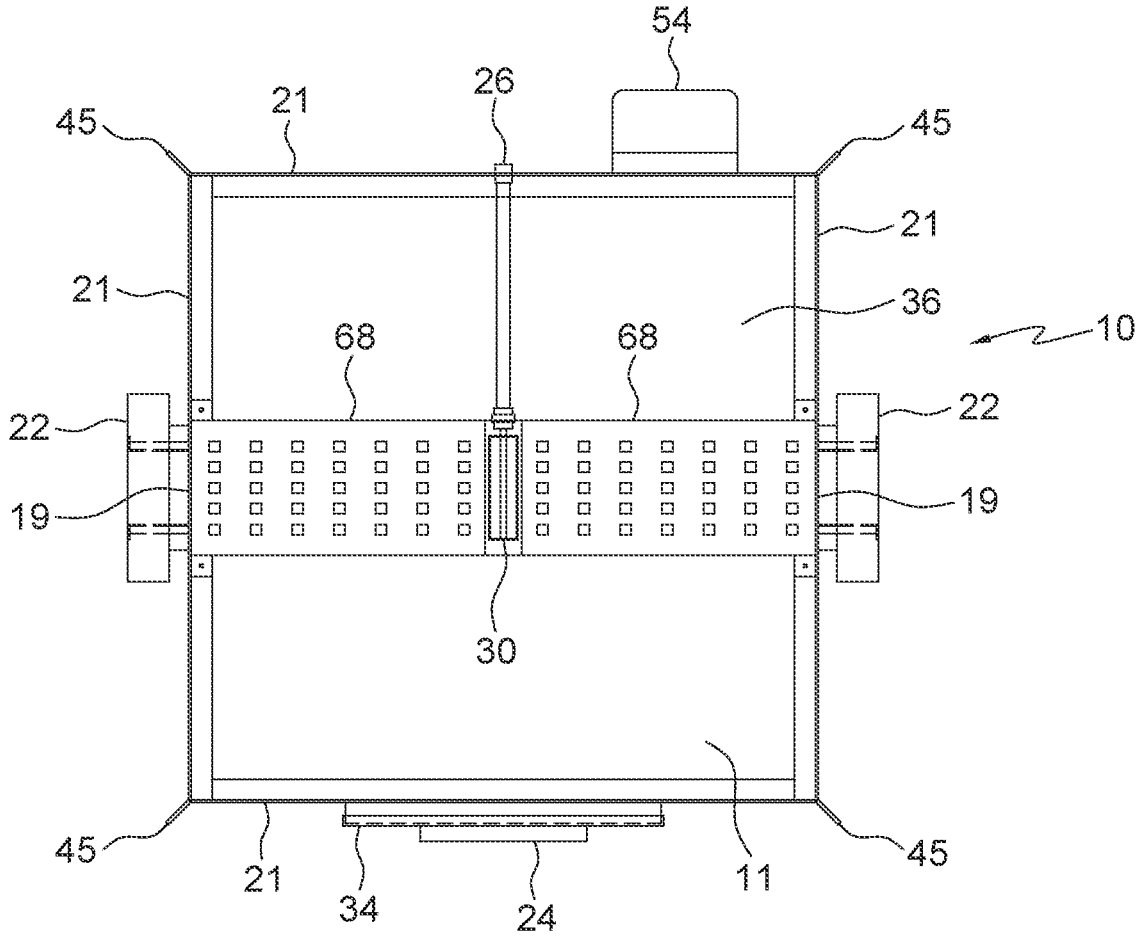
FIG. 4 is a top plan view depicting the combustor of FIG. 1.
Figure 5:
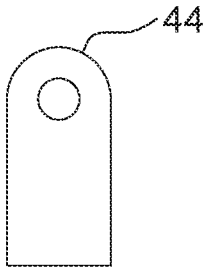
FIG. 5 is a side elevation view depicting a lifting lug of the combustor of FIG. 1.
Figure 6:
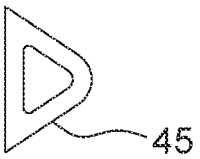
FIG. 6 is a side elevation view depicting a tie down lug of the combustor of FIG. 1.
Figure 7:
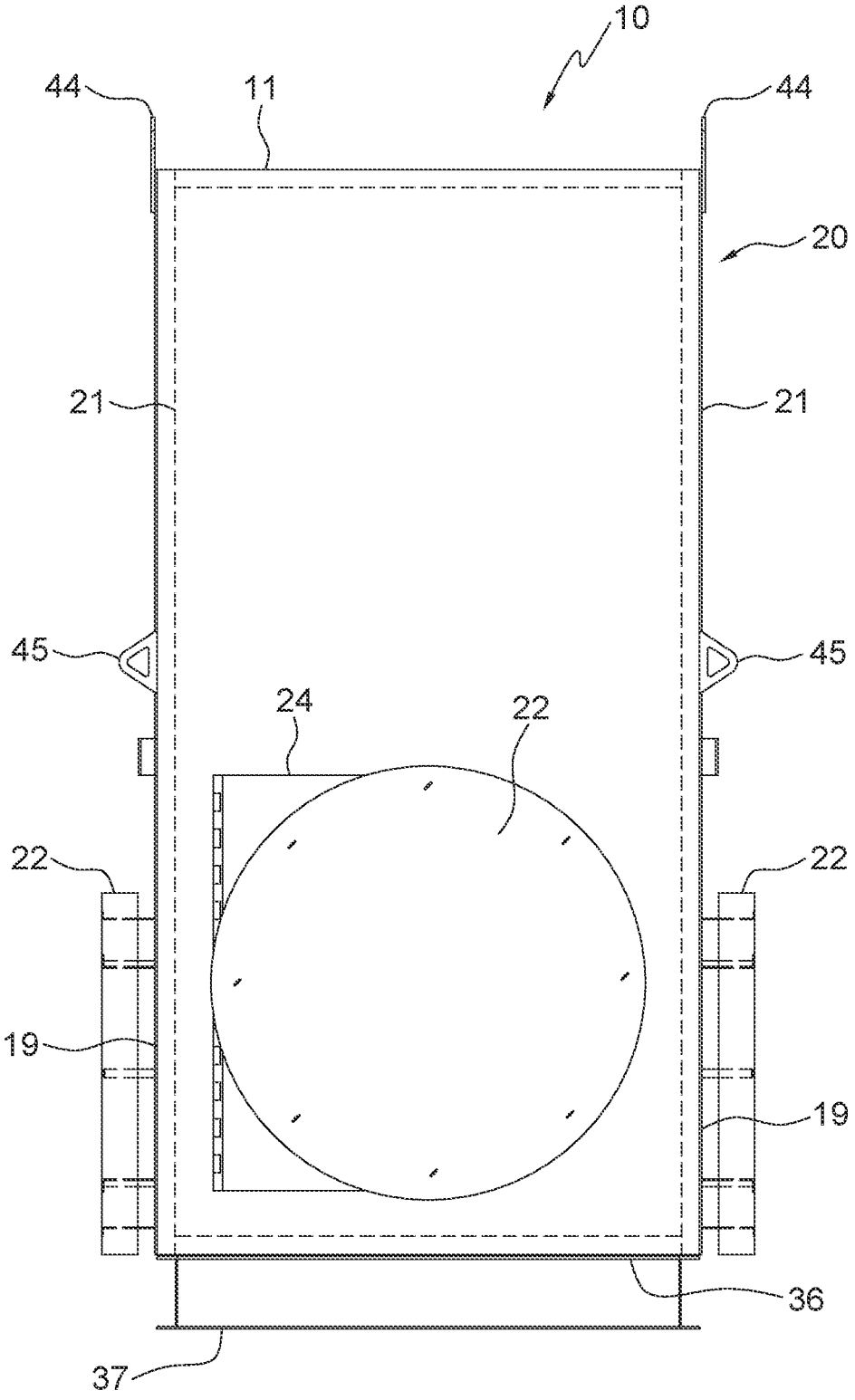
FIG. 7 is a front elevation view depicting a second embodiment of a combustor.
Figure 8:
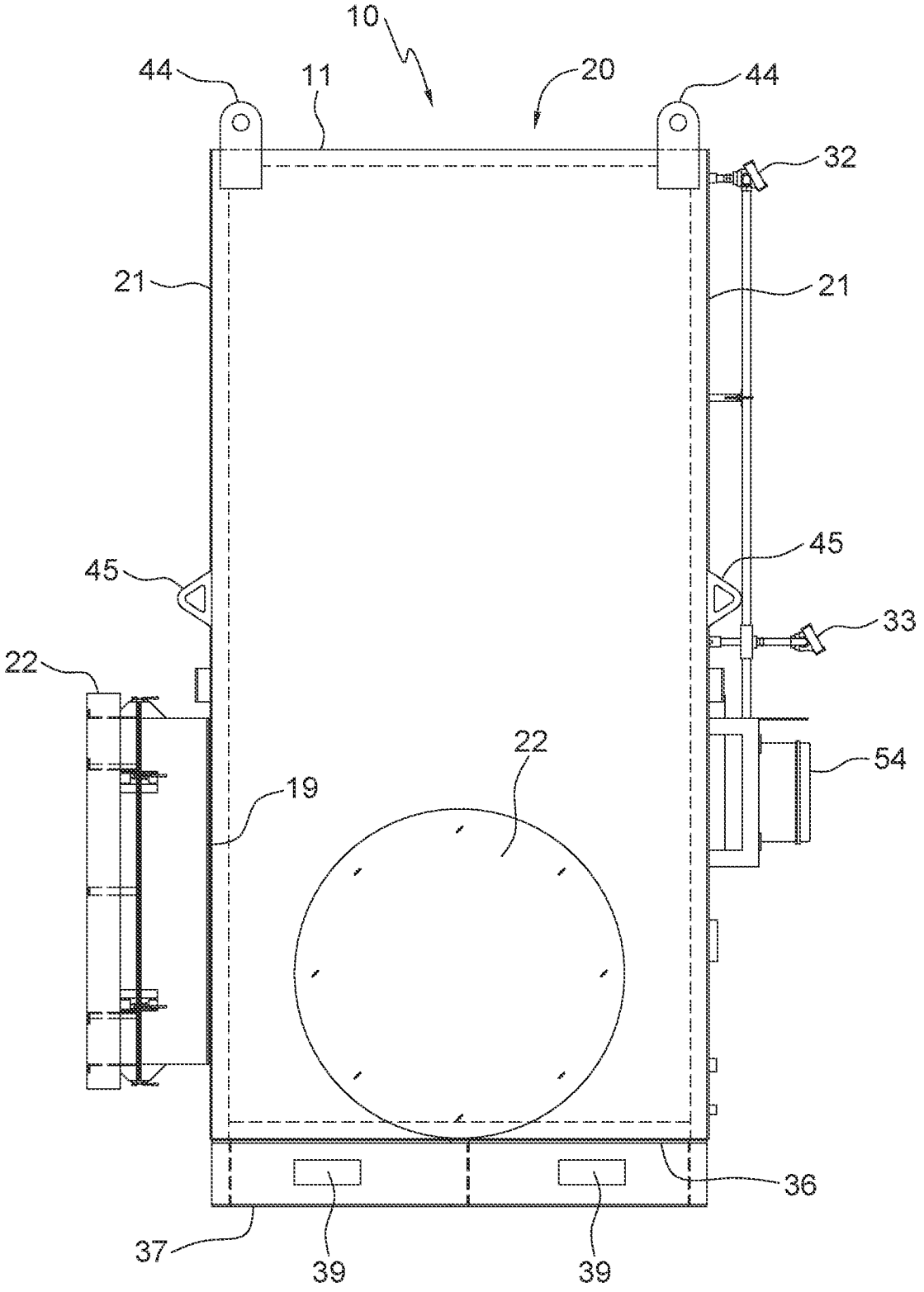
FIG. 8 is a side elevation view depicting the combustor of FIG. 7.
Figure 9:
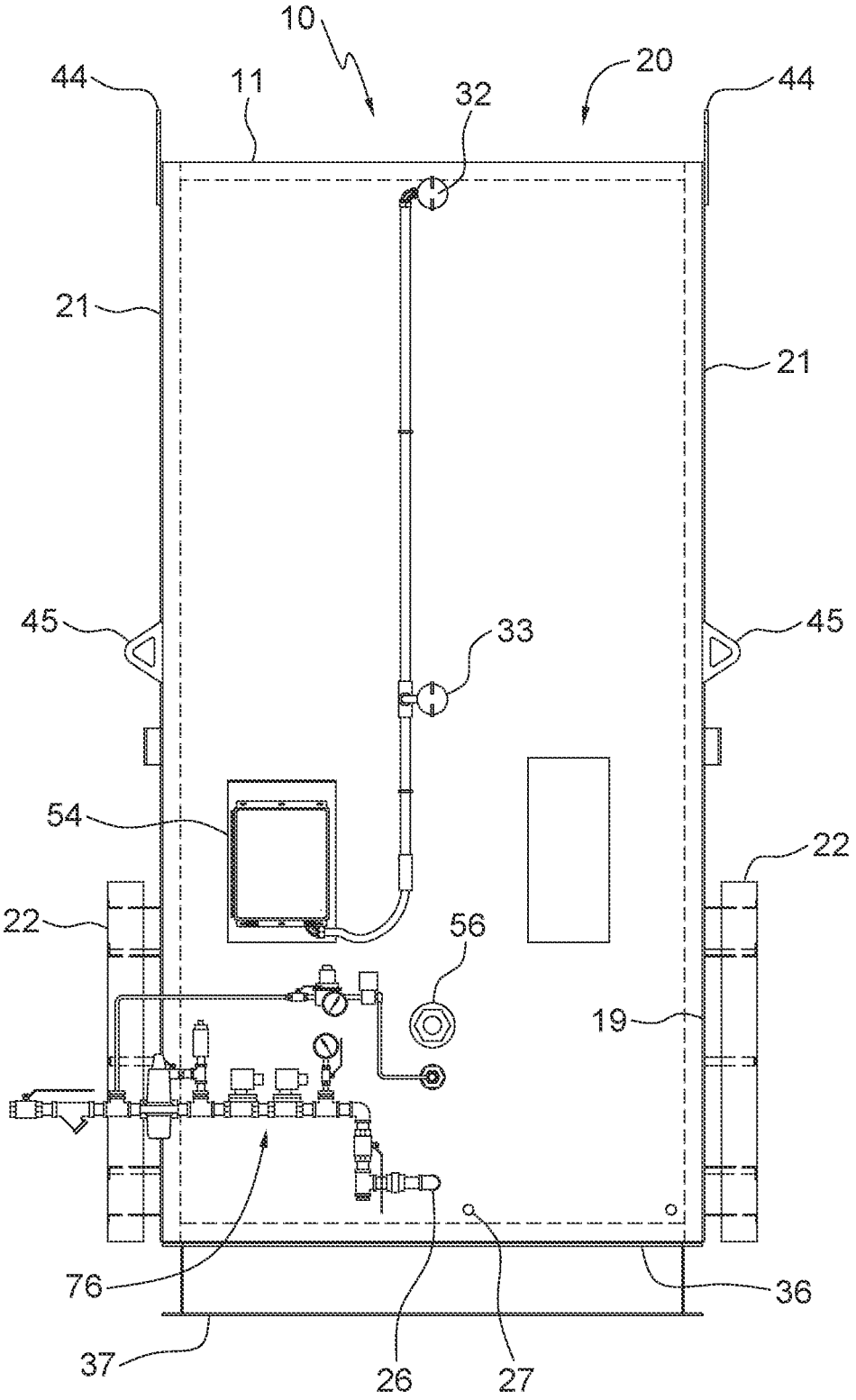
FIG. 9 is a rear elevation view depicting the combustor of FIG. 7.
Figure 10:
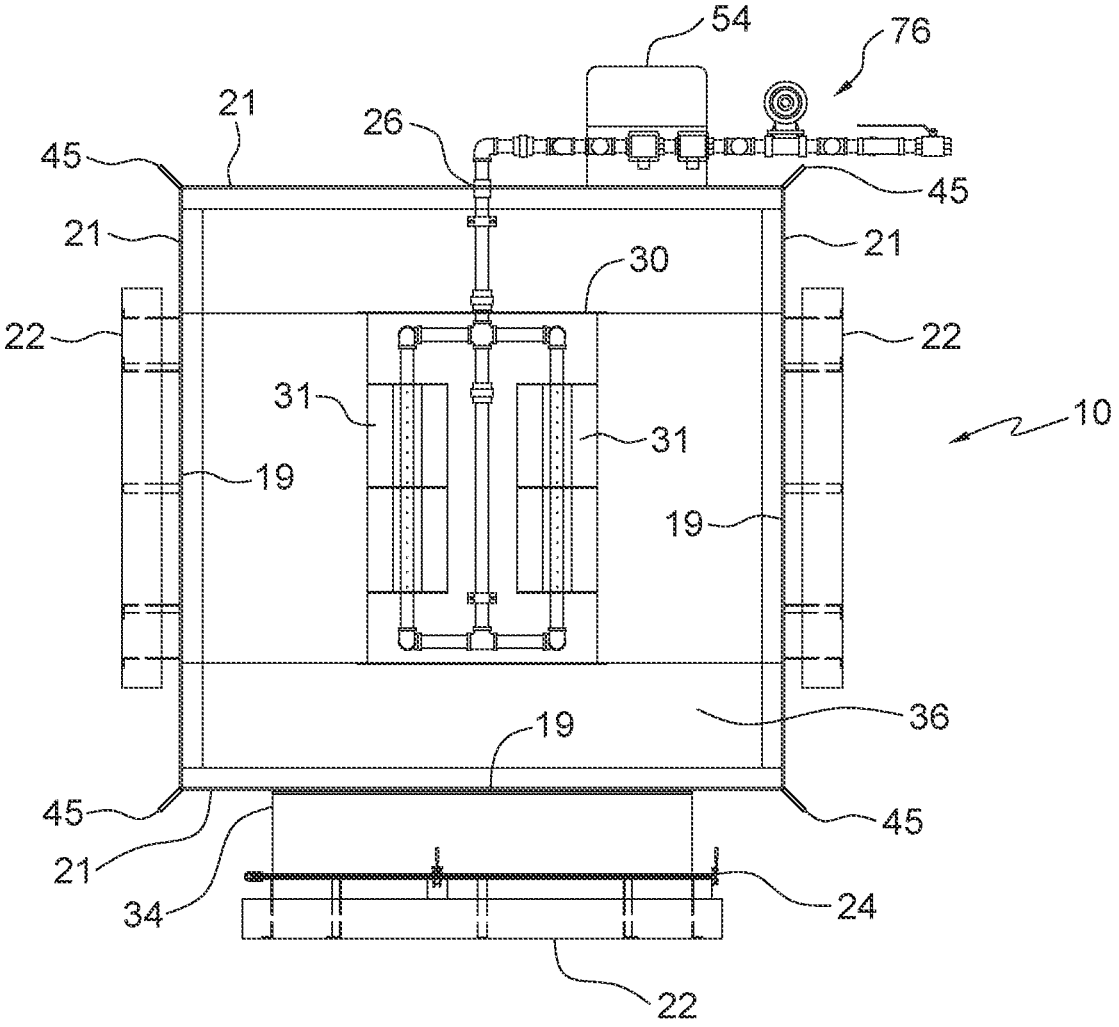
FIG. 10 is a top plan view depicting the combustor of FIG. 7.

Referring to the Figures, an embodiment of an improved combustor 10 is shown. Referring to FIGS. 1 to 6, a first embodiment of combustor 10 is shown, which can further comprise of base box 20 that can comprise of base plate 36 and sidewall panels 21 extending upwardly therefrom to form a rectangular prism-like structure wherein the uppermost portion is open to the atmosphere via opening 11. In some embodiments, base plate 36 can be disposed on top of a support structure or skid 37. In some embodiments, skid 37 can comprise slots 39, as shown in FIG. 8, to accommodate forklift forks to inserted therein so that combustor 10 can be lifted and transported with a forklift. In some embodiments, combustor 10 can comprise a plurality of lifting lugs 44 disposed thereon near opening 11 to provide means for lifting combustor onto and off of a trailer or transport truck with a crane, as well known to those skilled in the art. In some embodiments, combustor 10 can comprise a plurality of tie down lugs 45 disposed therearound for securing combustor 10 to a trailer or transport truck with straps, ropes, chains, etc. as well known to those skilled in the art.

In some embodiments, base plate 36 can be square in configuration. In a representative embodiment, base plate 36 can measure approximately 60" on each side thereof. In some embodiments, sidewall panels 21 can be rectangular in configuration. In a representative embodiment, each sidewall panel 21 can measure approximately 60" wide and 120" tall. In some embodiments, this configuration of combustor 10 can permit 7 units thereof to fit onto, and be transported by, a 53-foot-long flat deck trailer, as well known by those skilled in the art. In some embodiments, 8 units combustor 10 can be placed on a B-train trailer, as well known by those skilled in the art. In some embodiments, this configuration of combustor 10 can result in it having a weight of 2875 pounds. In this configuration, combustor 10 has been engineered to be placed at a site without guy wires and withstand winds up to 133 kilometers per hour without toppling. In actual installations, it was observed that the combustor to withstand wind gusts up to 160 kilometers per hour without toppling.

Figure 14:
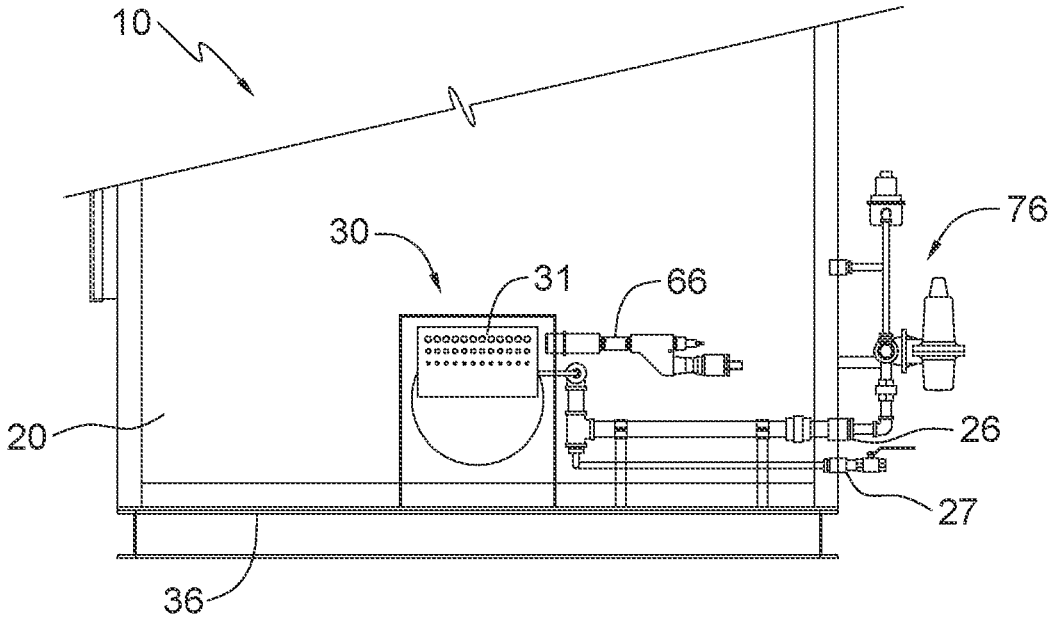
FIG. 14 is a side elevation view depicting the burner assembly of FIG. 11.

In some embodiments, combustor 10 can comprise burner assembly 30 disposed therein. In some embodiments, burner assembly 30 can be supplied with waste gas flowing through gas inlet pipe 26 to be combusted. In some embodiments, the waste gas can flow through valve train 76 prior to passing into inlet pipe 26. In some embodiments, valve train 76 can comprise one or more of valves, water separators, pressure gauges, pipe tees and fittings and any other device as well known to those skilled in the art for safe handling of hydrocarbon gases. In some embodiments, valve train 76 can comprise pilot regulator 78 configured for providing a stream of pressure-regulated hydrogen gas to igniter 66 (as shown in FIG. 14) to enable safe ignition and combustion of the waste hydrogen gas. Any moisture or liquids that can accumulate in the waste gas can drain from gas inlet pipe 26 via drainpipe 27 coupled thereto.

In some embodiments, base box 20 can comprise access door 24 disposed on one sidewall panel 21 of base box 20 to permit ingress in base box 20 by service personnel. Access door 24 can be attached to door frame 34, which can be comprised of square steel tubing, with hinges and/or fasteners as well known to those skilled in the art. In some embodiments, base box 20 can comprise sight glass 56 disposed on a sidewall panel 21 thereof to provide means for service personnel to visually inspect the interior of combustor 10 without physically entering it.

Figure 16:
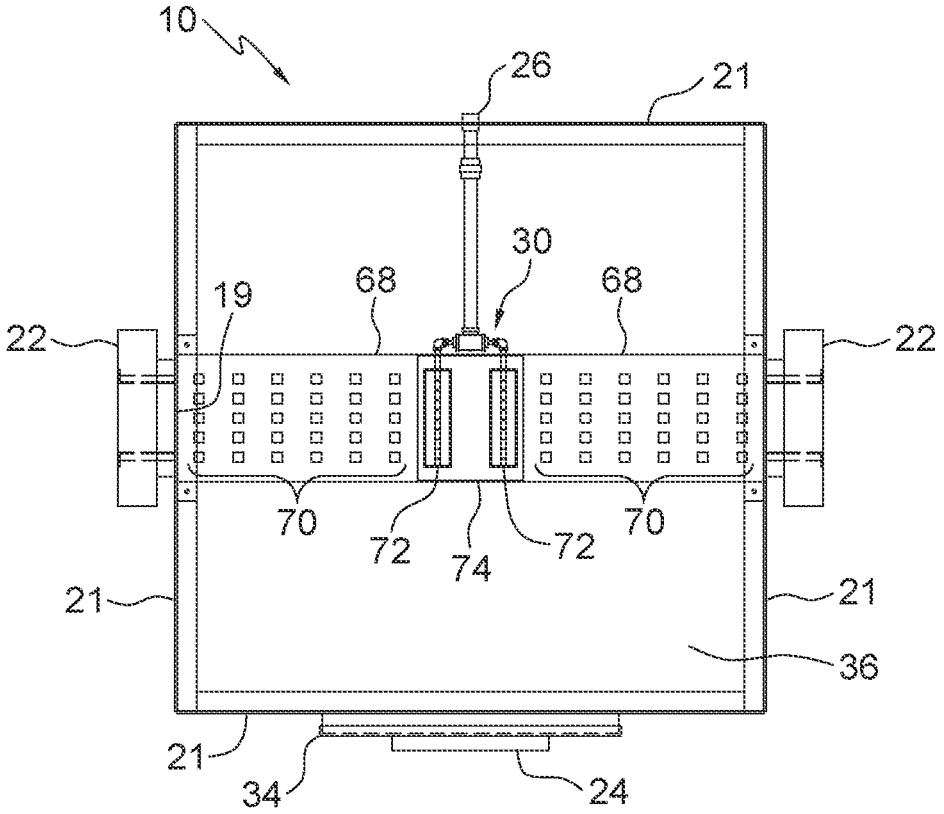
FIG. 16 is a top plan view depicting an air inlet air duct of combustor base box of FIG. 1.
Figure 17:
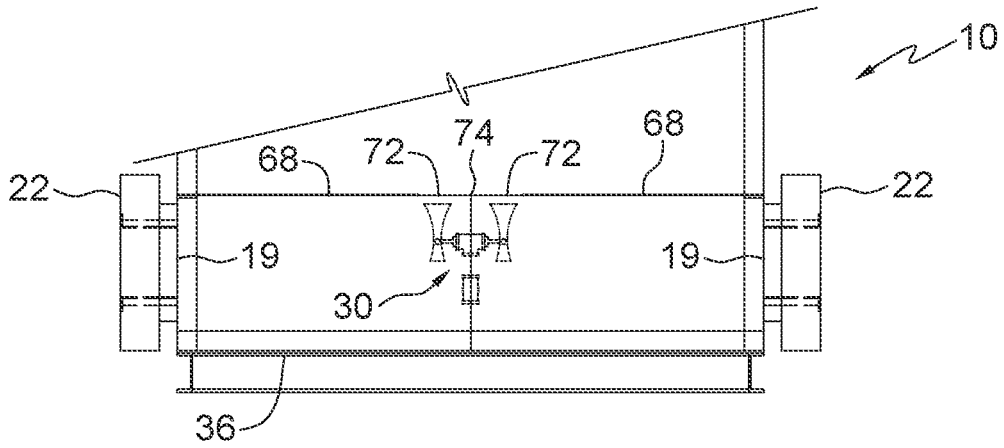
FIG. 17 is a side elevation view depicting the air inlet air duct of FIG. 16.

In some embodiments, combustor 10 can comprise flame arrestors 22 disposed on opposing sidewall panels 21 thereof to allow outside atmospheric air to enter through openings 19 into base box 20 as combustion air for burner assembly 30 wherein flame arrestors 22 prevent or inhibit flames from passing from within base box 20 to the atmosphere outside of base box 20. In some embodiments, combustor 10 can comprise of one or more air intake ducts 68 configured to channel outside atmospheric air drawn in through flame arrestors 22 and openings 19, and then direct the atmospheric air underneath burner assembly 30 to provide combustion air thereto. Referring to FIGS. 16 and 17, one embodiment of intake duct 68 is shown in more detail. In some embodiments, two intake ducts 68 can be disposed on base plate, operatively coupled to on opposing sidewall panels 21 to flame arrestors 22 providing communication from an outer end adjacent to flame arrestor 22 to an inner end configured to be disposed beneath burner assembly 30. In some embodiments, the inner end of intake ducts 68 can comprise a notched opening 72. In some embodiments, the inner ends of intake ducts 68 can abutted to each other but separated by gap 74, as shown in FIGS. 16 and 17. In this configuration, the notched openings 72 of the two intake ducts 68 can provide an opening for combustion air to exit therefrom and flow towards burner assembly 30. In some embodiments, one or both intake ducts 68 can each comprise a plurality of openings 70 configured to allow air to pass therethrough to provide a flow of air to rise along with combustion gases produced by burner assembly 30 and exit combustor 10 as exhaust gas from opening 11.

In some embodiments, combustor 10 can comprise of controller 54 configured to control the operation of combustor 10 including, but not limited to, burner assembly 30. In some embodiments, controller 54 can comprise one or more of a programmable logic controller, a microcontroller, a personal computer and any other device that can be used for system or supervisory control and data acquisition as well known to those skilled in the art. In a representative embodiment, controller 54 can comprise a CSC 400 Combustion Safety Control controller as manufactured by Clear Rush Corporation of Sundre, Alberta, Canada. In some embodiments, combustor 10 can comprise of one or more thermocouple configured to measure temperature at different physical locations on combustor 10 to provide temperature control information or signals to controller 54 that can be, in turn, used in the operation of burner assembly 30. In some embodiments, combustor 10 can comprise of exhaust gas temperature thermocouple 32 disposed near opening 11, which can be operatively coupled to controller 54 and further configured to measure the temperature of exhaust gases exiting combustor 10 through opening 11. In some embodiments, combustor 10 can comprise of skin temperature thermocouple 33 disposed on one sidewall panel 21, which can be operatively coupled to controller 54 and further configured to measure the skin temperature of a sidewall panel 21. In some embodiments, one or both of thermocouples 32 and 33 can comprise a Type-K thermocouple as well known to those skilled in the art.

In some embodiments, controller 54 can measure temperatures and gas pressure and flow to control safe ignition and monitoring of the pilot flame and can further control main/waste gas flow into the combustor. Thermocouples 32 and 33 connected to controller 54 can be used to measure the temperature of the lower outer skin of combustor 10 and the stack air exit temperature. In some embodiments, controller 54 can utilize a pressure transmitter connected to a first 4-20 mA input of controller 54 to control the opening and closing of the main gas solenoid valves. In some embodiments, controller 54 can use a second 4-20 mA input of controller 54 to measure the gas flow via direct flow meter 77 or by calculating flow using a second pressure transmitter and the number of orifices in the burner. In some embodiments, controller 54 can record the total gas flow to combustor 10 in standard cubic feet per day ("SCFD"), calculated every second if the main valve(s) are open. In some embodiments, controller 54 can send this data through a secured, encrypted internet connection to an offsite server via a cellular modem.

Temperature measured at either of thermocouples 32 or 33 can provide temperature information to controller 54 in terms of whether the exhaust gas temperature or the sidewall skin temperature exceed a safe operating temperature. This temperature can be set to a temperature below the auto-ignition temperature of the waste gases present at the site. Should the temperature measured by the thermocouples approach the safe operating temperature, controller 54 can shut down operation of combustor 10, such as sending a valve control signal to a solenoid-controlled valve as well known to those skilled in the art (not shown) controlling the flow of waste gas into gas inlet pipe 26 to close said valve and stop combustion of waste. When temperatures measured by thermocouples 32 and 33 drop to a safe operating temperature, controller 54 can send another valve control signal to the solenoid-controlled valve to open the valve and allow waste gas to flow into burner assembly 30 and then controller 54 can send an ignition signal to igniter 66, as shown in FIG. 14, to ignite the waste gas and begin combustion of the waste gas.

Referring to FIGS. 7 to 10, a second embodiment of combustor 10 is shown. In this embodiment, combustor 10 can be similar in configuration and structure to that of the first embodiment as described above. In this embodiment, burner assembly 30 can be larger than the one used for the first embodiment shown in FIGS. 1 to 4 and, thus, can be used to combust a larger volume of waste gas than that of the first embodiment. In this embodiment, combustor 10 can comprise larger flame arrestors 22 to allow a larger volume of outside atmospheric air to be drawn into combustor 10 as combustion air for the larger burner assembly 30. In some embodiments, access door 24 can comprise a third flame arrestor 22 disposed thereon to allow even more outside atmospheric air to be drawn into base box 20 as combustion air for burner assembly 30.

Figure 11:
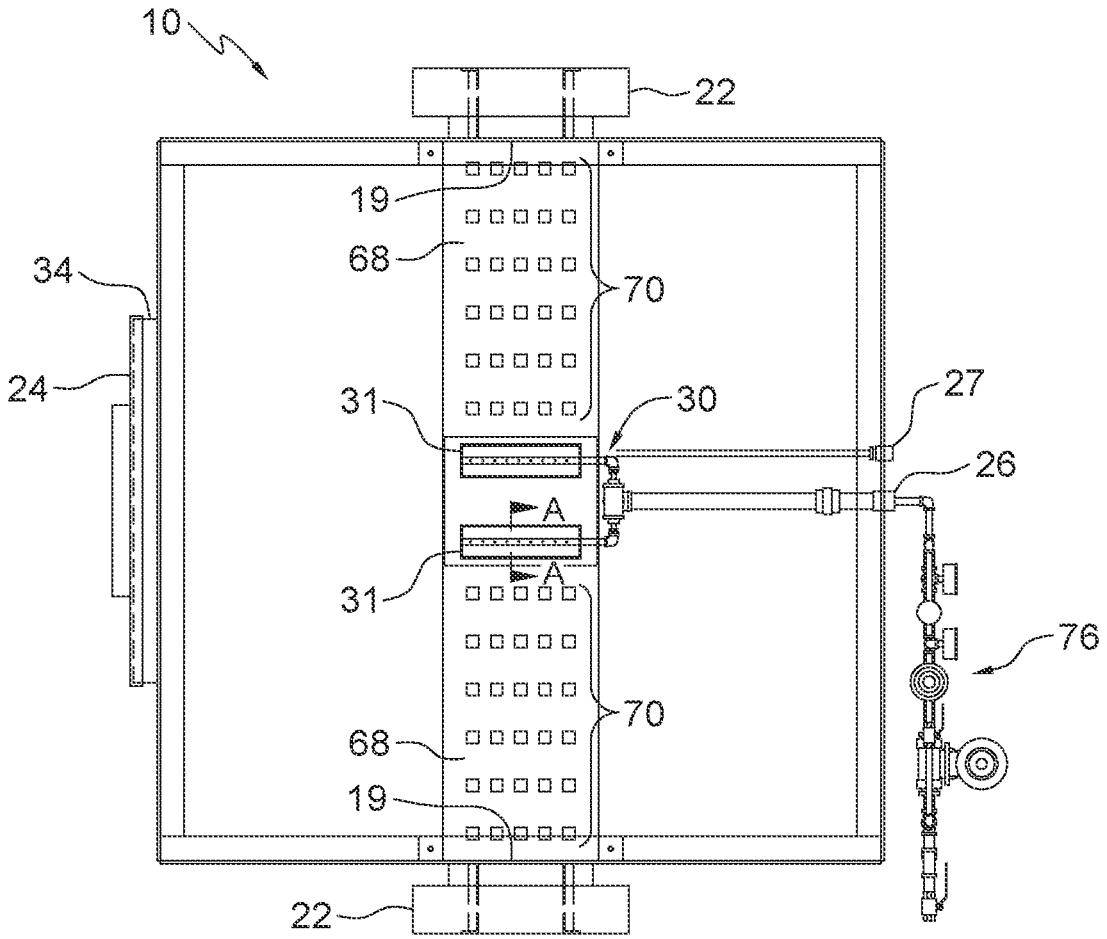
FIG. 11 is a top plan view depicting a burner assembly of the combustor of FIG. 7.
Figure 12:
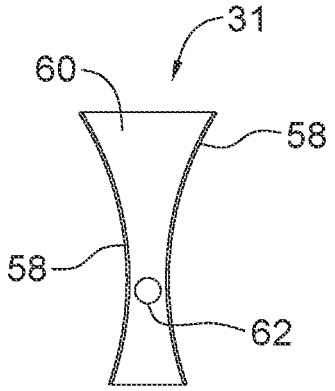
FIG. 12 is an end elevation view depicting a burner of the burner assembly of FIG. 11.
Figure 13:
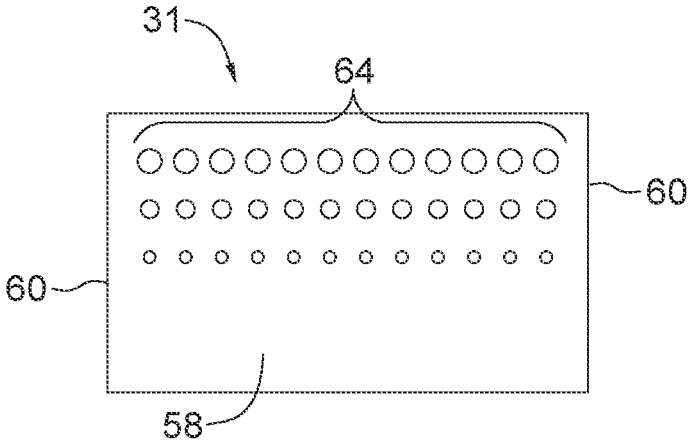
FIG. 13 is a side elevation view depicting the burner of FIG. 12.
Figure 15:
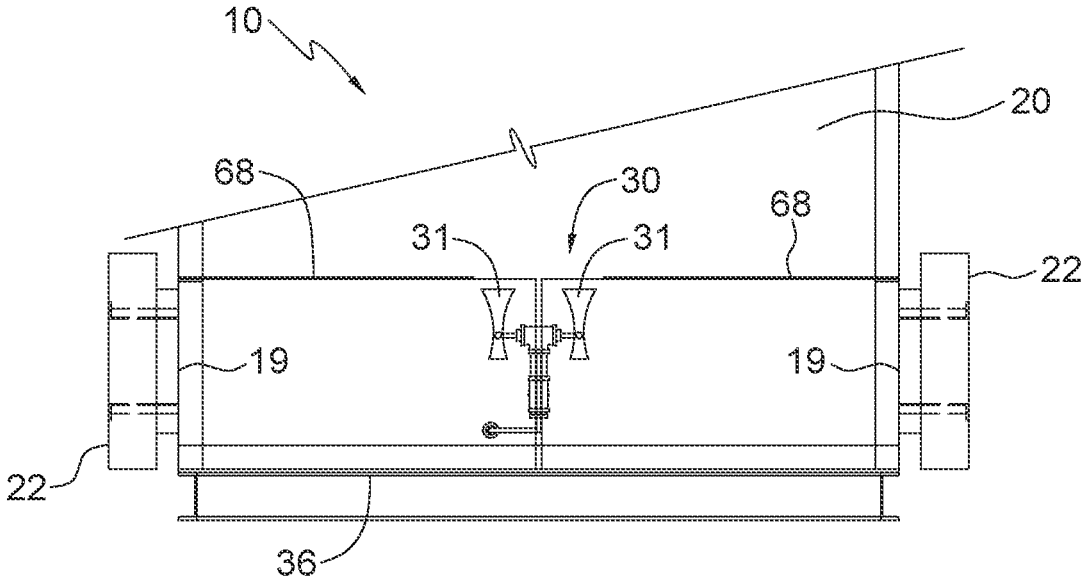
FIG. 15 is a front elevation view depicting the burner assembly of FIG. 11.

Referring to FIGS. 11 to 15, an embodiment of burner assembly 30 for use with the combustor 10 of FIGS. 1 to 4 is shown. In this embodiment, burner assembly 30 can comprise two burner units 31, wherein burner units 31 can be configured in a side-by-side configuration as shown in FIGS. 11 and 15. In some embodiments, each burner unit 31 can comprise of two substantially parallel sidewalls 58 wherein each sidewall 58 can comprise a concave figuration on an outer side thereof. The parallel sidewalls 58 can be bounded by end plates 60 on opposing ends thereof to provide a unitary structure for burner unit 31. In some embodiments, sidewalls 58 can be comprised of 1/16" thick stainless steel whereas end plates 60 can be comprised of 1/8" thick stainless steel. Combustion air can be drawn into combustor 10 through flame arrestor 22 and opening 19 and be guided by intake ducts 68 to burner assembly 30.

In some embodiments, each burner unit 31 can comprise burner pipe 62 disposed between sidewalls 58 wherein burner pipe 62 can comprise of a ¼" schedule 40 pipe therein with perforations disposed through on a top surface thereof to provide means for waste gas to pass through to be combusted. In some embodiments, the concave configuration of sidewalls 58 can provide a venturi-like throat structure having an opening of approximately 1½" wide on a lower portion thereof and an opening of approximately 2¾" wide on an upper portion thereof wherein burner pipe 62 can be disposed in the narrowest portion of said throat. Waste gas can be provided to burner units 31 via gas inlet pipe 26.

In some embodiments, one or both of sidewalls 58 can comprise a plurality of perforations 64 disposed therethrough to provide a means for combustion air to enter burner unit 31. In some embodiments, the perforations can comprise the same approximate size whereas the size of the perforations can vary from smaller to larger from a middle portion of sidewall 58 to an upper portion of sidewall 58. In some embodiments, burner assembly 30 can comprise one or more igniters 66 operatively connected to controller 54 wherein igniter 66 can be configured for igniting waste gas exiting burner pipe 62 upon receiving an ignition signal from controller 54 to operate and create a spark to ignite the waste gas to start combustion thereof. In some embodiments, igniter 66 can comprise a model 1500 igniter manufactured by Clear Rush Corporation of Sundre, Alberta, Canada.

Figure 18:
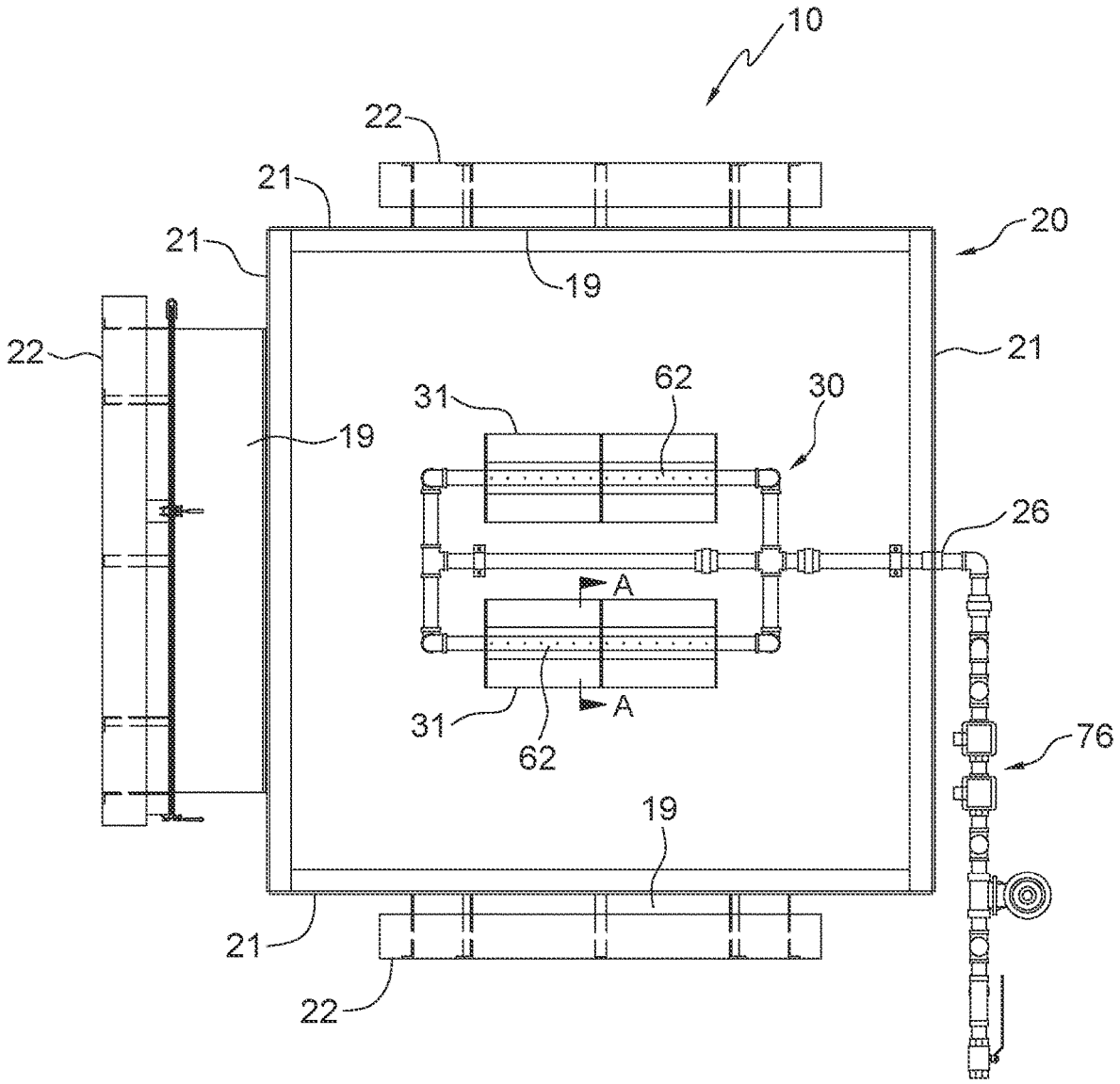
FIG. 18 is a top plan view depicting a burner assembly of the combustor of FIG. 7.
Figure 19:
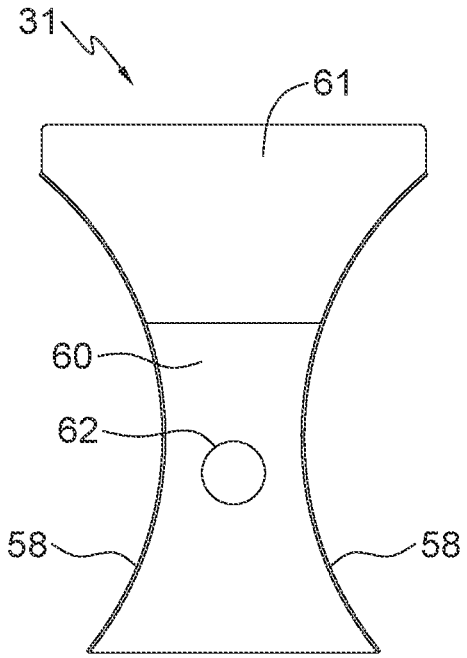
FIG. 19 is an end elevation view depicting a burner of the burner assembly of FIG. 18.
Figure 20:
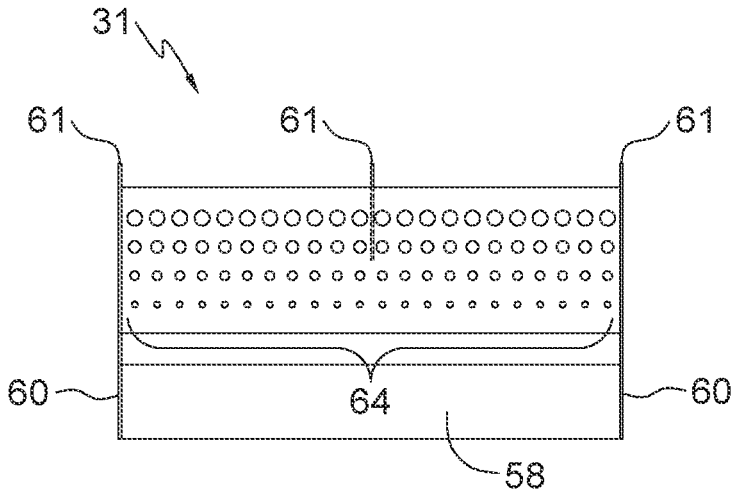
FIG. 20 is a side elevation view depicting the burner of FIG. 19.
Figure 21:
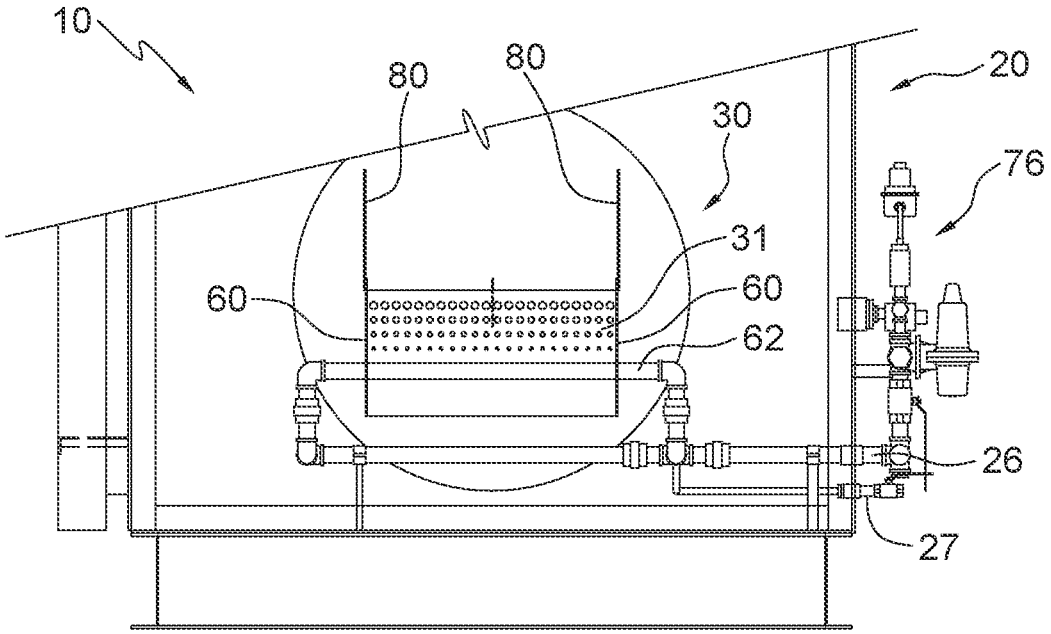
FIG. 21 is a side elevation view depicting the burner assembly of FIG. 18.
Figure 22:
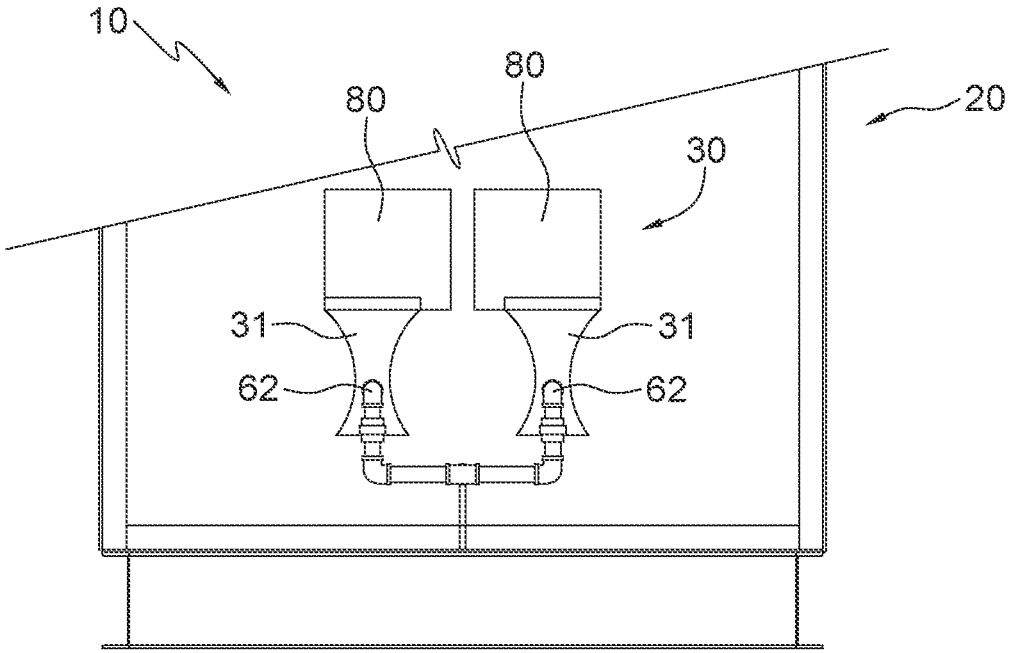
FIG. 22 is an end elevation view depicting the burner assembly of FIG. 18.

Referring to FIGS. 18 to 22, an embodiment of burner assembly 30 for use with the combustor 10 of FIGS. 7 to 10 is shown. In this embodiment, burner assembly 30 can comprise two burner units 31, wherein burner units 31 can be configured in a side-by-side configuration as shown in FIGS. 18 and 22. In some embodiments, each burner unit 31 can comprise of two substantially parallel sidewalls 58 wherein each sidewall 58 can comprise a concave figuration on an outer side thereof. The parallel sidewalls 58 can be bounded by end plates 60 on opposing ends thereof to provide a unitary structure for burner unit 31. In some embodiments, burner unit 31 can comprise a plurality of top braces 61 to provide structural rigidity and strength to burner unit 31. In some embodiments, sidewalls 58 can be comprised of 1/16" thick stainless steel whereas end plates 60 and top braces 61 can be comprised of ⅛" thick stainless steel.

In some embodiments, each burner unit 31 can comprise burner pipe 62 disposed between sidewalls 58 wherein burner pipe 62 can comprise of a 1" schedule 40 pipe therein with perforations disposed through on a top surface thereof to provide means for waste gas to pass through to be combusted. In some embodiments, the concave configuration of sidewalls 58 can provide a venturi-like throat structure having an opening of approximately 6" wide on a lower portion thereof and an opening of approximately 8" wide on an upper portion thereof wherein burner pipe 62 can be disposed in the narrowest portion of said throat. Waste gas can be provided to burner units 31 via gas inlet pipe 26.

In some embodiments, one or both of sidewalls 58 can comprise a plurality of perforations 64 disposed therethrough to provide a means for combustion air to enter burner unit 31. In some embodiments, the perforations can comprise the same approximate size whereas the size of perforations 64 can vary from smaller to larger from a middle portion of sidewall 58 to an upper portion of sidewall 58. In some embodiments, burner assembly 30 can comprise one or more igniters 66 operatively connected to controller 54 wherein igniter 66 can be configured for igniting waste gas exiting burner pipe 62 upon receiving an ignition signal from controller 54 to operate and create a spark to ignite the waste gas to start combustion thereof. In some embodiments, burner units 31 can further comprise flame containment plates 80 disposed above end plates 60, as shown in FIGS. 21 and 22, to contain or focus flames emitted from burner units 31 within combustor 10.

Figure 23:
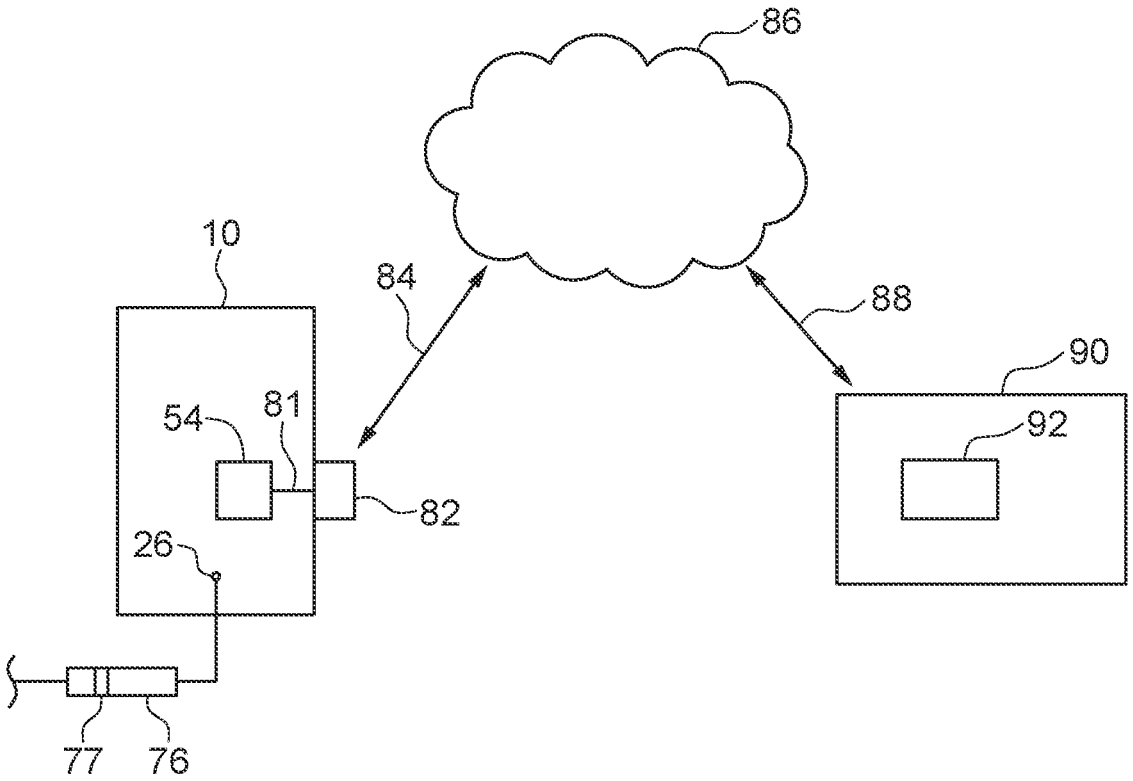
FIG. 23 is a block diagram depicting a combustor with a communication link from a SCADA unit to a central control center.

Referring to FIG. 23, one embodiment of a system is shown where combustor 10 in communication with server 92 located in central control center 90. In some embodiments, controller 54 can be operatively connected to cellular modem via communication link 81. Communication link 81 can comprise of a multi-conductor instrumentation cable as well known to those skilled in the art. In a representative embodiment, cellular modem 82 can comprise a Microhard IPn4Gii-NA2 cellular modem as manufactured by Microhard Systems Inc. of Calgary, Alberta, Canada. In some embodiments, communications link 81 can comprise of CAT-5 telecommunication cable configured to operate as MODBus link using RS-485 communication protocol between controller 54 and cellular modem 82. In some embodiments, cellular modem 82 can be wirelessly coupled to telecommunications network 86 via wireless transmission link 84.

In some embodiments, telecommunication network 86 can comprise one or more of a public switched telephone network ("PSTN") and a private telecommunications network. In some embodiments, telecommunications network 86 can operatively coupled to server 92 at central control center 90 via transmission link 88, which can comprise of one or both of wired and wireless telecommunications systems.

In some embodiments, controller 54 can control the operation of valve train 76 and igniter 66 for combustor 10 to burn waste gas. In some embodiments, controller 54 can monitor the temperature measured by thermocouples 32 and 33 as well as the amount of gas flowing through valve train 76 via flow meter 77 disposed within valve train 76 and then relay temperature data and gas flow rate data to server 92 at central control center 90 via communications network 86 where the temperature data and gas flow rate data can be received by server 92, which can comprise a personal computer as well known to those skilled in the art, operating a software application configured for monitoring and controlling controller 54. With data received from controller 54, the software application on server 92 can be configured to determine the total amount of waste gas burned by any particular combustor 10 operatively connected to server 92 and, thus, can further determine the value of the carbon credits associated with the amount of waste gas burned by that particular combustor 10.

In some embodiments, one or both of controller 54 and cellular modem 82 disposed on a combustor 10 can comprise global positioning system functionality of which the location data thereof and, thus, that of combustor 10 which can be relayed to server 92.

Although a few embodiments have been shown and described, it will be appreciated by those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

What is claimed is:

1. A combustor, comprising:

a) an enclosure, further comprising a bottom panel and a plurality of sidewall panels disposed around a perimeter of the bottom panel, the plurality of sidewall panels extending upwardly from the perimeter of the bottom panel, the plurality of sidewall panels operatively coupled together around the perimeter to form a combustion chamber, wherein an uppermost portion of the enclosure is open about the perimeter, and wherein;

b) a burner assembly disposed within the combustion chamber;

c) a gas inlet pipe operatively coupled to the burner assembly, the gas inlet pipe configured to supply waste gas to the burner assembly;

d) an air inlet disposed through at least one of the plurality of sidewall panels; and e) at least one flame arrestor operatively coupled to the air inlet on an exterior side of the plurality of sidewall panels, the at least one flame arrestor configured to allow atmospheric air to enter the combustion chamber for use as combustion air for the burner assembly.

2. The combustor as set forth in claim 1, further comprising an access door disposed on one of the sidewall panels.

3. The combustor as set forth in claim 2, wherein the access door comprises one of the at least one flame arrestor disposed thereon.

4. The combustor as set forth in claim 1, further comprising an air intake duct configured for providing communication from the air inlet to the burner assembly.

5. The combustor as set forth in claim 1, wherein the bottom panel is square in configuration and each of the plurality of sidewall panels are rectangular in configuration.

6. The combustor as forth in claim 5, wherein the bottom panel is up to 60 inches by 60 inches in dimension and each of the plurality of sidewall panels is up to 60 inches by 120 inches in dimension.

7. The combustor as set forth in claim 1, wherein the burner assembly further comprises at least one burner unit wherein each of the at least one burner unit comprises:

a) a pair of parallel concave sidewalls configured to form a venturi-like throat structure, each concave sidewall comprising a plurality of holes disposed therethrough;

b) a pair of parallel end plates, each end plate disposed at opposing ends of the concave sidewalls and operatively coupled thereto; and c) a burner pipe disposed between the concave sidewalls in the venturi-like throat structure.

8. The combustor as set forth in claim 7, wherein the at least one burner unit comprises a plurality of top braces disposed between the concave sidewalls.

9. The combustor as set forth in claim 7, further comprising a flame containment plate disposed on top of one or both of the parallel end plates.

10. The combustor as set forth in claim 7, further comprising a controller configured for controlling the operation of the burner assembly.

11. The combustor as set forth in claim 10, wherein the burner assembly comprises at least one igniter configured for igniting waste gas exiting the burner pipe upon receiving an ignition signal from the controller.

12. The combustor as set forth in claim 10, further comprising an exhaust gas temperature thermocouple operatively coupled to the controller.

13. The combustor as set forth in claim 10, further comprising a sidewall panel skin temperature thermocouple operatively coupled to the controller.

14. The combustor as set forth in claim 10, further comprising a wireless communications transceiver operatively coupled to the controller, the wireless transceiver configured to exchange data with a server over a telecommunications network.

15. The combustor as set forth in claim 1, further comprising a valve train operatively coupled to the gas inlet pipe, the valve train configured to control and monitor the flow of the waste gas into the gas inlet pipe.

16. A method for determining the amount of waste gas supplied to a combustor, comprising:

a) supplying the waste gas to the combustor, the combustor comprising:

i) an enclosure, further comprising a bottom panel and a plurality of sidewall panels disposed around a perimeter of the bottom panel, the plurality of sidewall panels extending upwardly from the perimeter of the bottom panel, the plurality of sidewall panels operatively coupled together around the perimeter to form a combustion chamber, wherein an uppermost portion of the enclosure is open about the perimeter, and wherein, ii) a burner assembly disposed within the combustion chamber, iii) a gas inlet pipe operatively coupled to the burner assembly, the gas inlet pipe configured to supply waste gas to the burner assembly, iv) an air inlet disposed through at least one of the plurality of sidewall panels, and v) at least one flame arrestor operatively coupled to the air inlet on an exterior side of the plurality of sidewall panels, the at least one flame arrestor configured to allow atmospheric air to enter the combustion chamber for use as combustion air for the burner assembly;

b) monitoring the amount of the waste gas supplied to the combustor with a flow meter, the flow meter configured to provide a gas flow signal to a controller, the controller further configured to derive gas flow data from the gas flow signal;

c) transmitting the gas flow data to a central control center;

d) determining the amount of the waste gas supplied to and burned by the combustor from the gas flow data; and e) determining the amount of carbon credits associated with the amount of the waste gas supplied to and burned by the combustor.

17. The method as set forth in claim 16, further comprising transmitting the gas flow data over a telecommunications network.

18. The combustor as set forth in claim 14, wherein the server is further configured to determine the amount of carbon credits associated with the amount of the waste gas supplied to and burned by the combustor.

* * * * *